US005261857A

United States Patent [19]

Petterson et al.

[11] Patent Number: 5,261,857

[45] Date of Patent: Nov. 16, 1993

[54] CEILING VENT WITH MOVABLE VANE

[76] Inventors: Bart Petterson, #5 Triad Center Suite 750, Salt Lake City, Utah 84180; James Cherrington, 195 Matterhorn Dr., Park City, Utah 84060; Michael Cherrington, 4770 Ichabod Pl., Salt Lake City, Utah 84117; Garry Rose, 1753 Vineyard, St. Helena, Calif. 94574

[21] Appl. No.: 902,706

[22] Filed: Jun. 23, 1992

[51] Int. Cl.[5] ..... F24F 13/072

[52] U.S. Cl. ..... 454/304

[58] Field of Search ..... 454/259, 290, 292, 304, 454/322, 333

[56] References Cited

U.S. PATENT DOCUMENTS 3,434,409 3/1969 Fragnito .
3,848,799 11/1974 Day .
3,926,102 12/1975 De Lepeleire ..... 454/290
4,008,653 2/1977 Tatham .
4,475,446 10/1984 McCall .
4,829,885 5/1989 McVicker ..... 454/254 X

FOREIGN PATENT DOCUMENTS 7409194 1/1975 Netherlands ..... 454/292

*Primary Examiner*—Harold Joyce
*Attorney, Agent, or Firm*—Thorpe North & Western

[57] ABSTRACT

A ceiling vent diffuses air from a heating or cooling system in a laminar flow into a room for optimum dispersion in the room. Inlet air strikes a hinged vane within the vent. The vane deflects the air in a narrowing air way along a continuous concave curvature and extending all the way to the outlet opening of the vent. The vane responds to the force of air flow to narrow or enlarge the air way and, thus, regulate the velocity of air exiting the vent. A curved air catch associated with the vane directs the outflow of air and also laterally disperses air within the vent. The vent maintains a relatively constant velocity and diffusion of air into a room despite variable flow rates from the source of air.

21 Claims, 1 Drawing Sheet

CEILING VENT WITH MOVABLE VANE

BACKGROUND OF THE INVENTION

This invention relates to a ceiling vent for dispersing air into a room. More particularly, this invention relates to a ceiling vent that diffuses hot or cold air along the top of a room for best dispersion into the room volume and evenly disperses variable-velocity air currents in laminar flow.

Perhaps the most critical component of a heating or cooling system in a home or office is the vent or diffuser for dispersing the heated or cooled air as evenly as possible throughout the room. If diffusion of the air throughout the room is uneven, then pools of air of different temperatures may form at various locations in the room. This is an inefficient way to heat or cool a room and can be uncomfortable to persons who live or work there.

The best known way to diffuse air in a room is to redirect the air in a laminar flow at the top of the room. This sheet of air then mixes with the ambient air to achieve relatively even heating or cooling without pooling or dumping in certain locations. The distance that air moves at a given velocity, or air flow throw, will vary with the velocity of the air that moves through a vent. Thus, differences in velocity will affect the evenness of air dispersion in a room. It is highly desirable to maintain constant the air flow throw from a vent, despite variations in initial air velocity, to control the even mixing of air in a room. A fluid, such as a current of air, that is moving at some velocity along an adjacent surface tends to cling to that surface. This is because low pressure is created below the current, in the case of a stream of air moving along a ceiling, thus lifting the current of air upward against the ceiling. This phenomenon, the Coanda effect, increases the air flow throw and thus the dispersion of air in a room.

One proposal for maintaining even mixing of air from a ceiling diffuser involved a device mounted on conventional ceiling tee bars and containing a thermostatically controlled motor to position air flow control vanes to manage variable flows of conditioned air (U.S. Pat. No. 3,848,799). Another device handled variable air flows by pumping air into a bladder to regulate the area of air discharge (U.S. Pat. No. 3,434,409). Other devices of general interest had to be manually adjusted to handle different air flows (U.S. Pat. Nos. 4,475,446 and 4,008,653). These devices all suffer the disadvantages of mechanical complexity or the need for manual adjustment to handle variations in air flow.

OBJECTS AND SUMMARY OF THE INVENTION

It is an object of the present invention to provide a ceiling vent that redirects the flow of hot or cold air from a heating or cooling system in a horizontal direction at the top of a room for optimum mixing with ambient air.

It is further an object of the present invention to variably control the width of the air discharge aperture to maintain constant the air flow throw from the vent.

Still another object of the present invention is to produce a current of air having uniform flow rate exiting the vent instead of one that has a high flow rate at the center of the current and lesser flow rates at the edges.

It is a further object of the present invention to provide a ceiling vent that is mechanically simple and inexpensive to manufacture.

These and other objects may be accomplished by providing a ceiling vent that contains a hingedly mounted vane in the path of inflowing air inside the plenum housing. This vane is normally biased toward an air catch which comprises a partition also positioned in the path of inflowing air to redirect and laterally diffuse air within the plenum. When there is no flow of air through the vent, the vane is disposed against the air catch to close the air discharge aperture. When air flows through the vent, the vane is moved away from the air catch by the force of the moving air to variably adjust the width of the air discharge aperture. Both the movable vane and the air catch are curved to redirect the flow of air in a horizontal direction as it leaves the vent. The air catch also circulates air within the plenum to disperse it toward the edges of the air current and homogenize the current velocities.

DETAILED DESCRIPTION OF THE INVENTION

Figure 2:
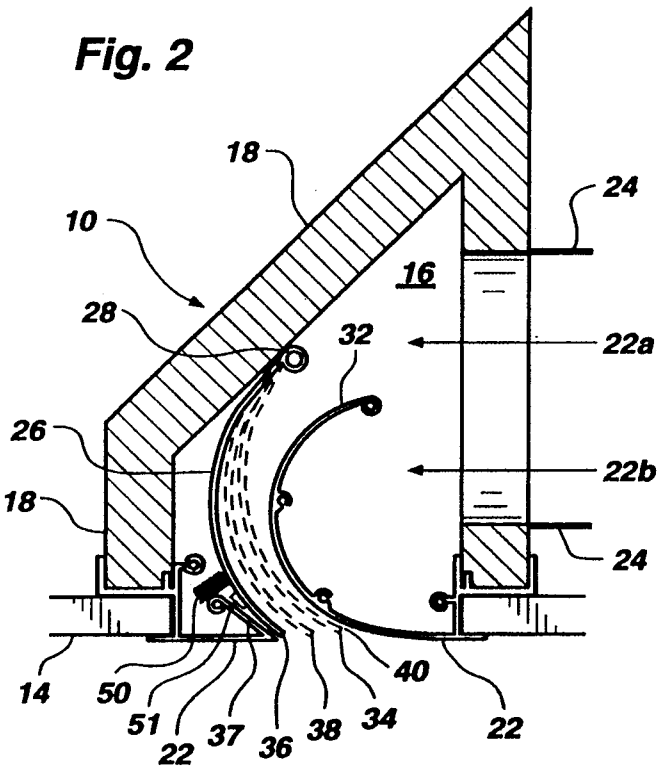
FIG. 2 shows an end elevational view of a ceiling vent with a movable vane and an air catch mounted in a gypsum board ceiling, according to the present invention.
Figure 1:
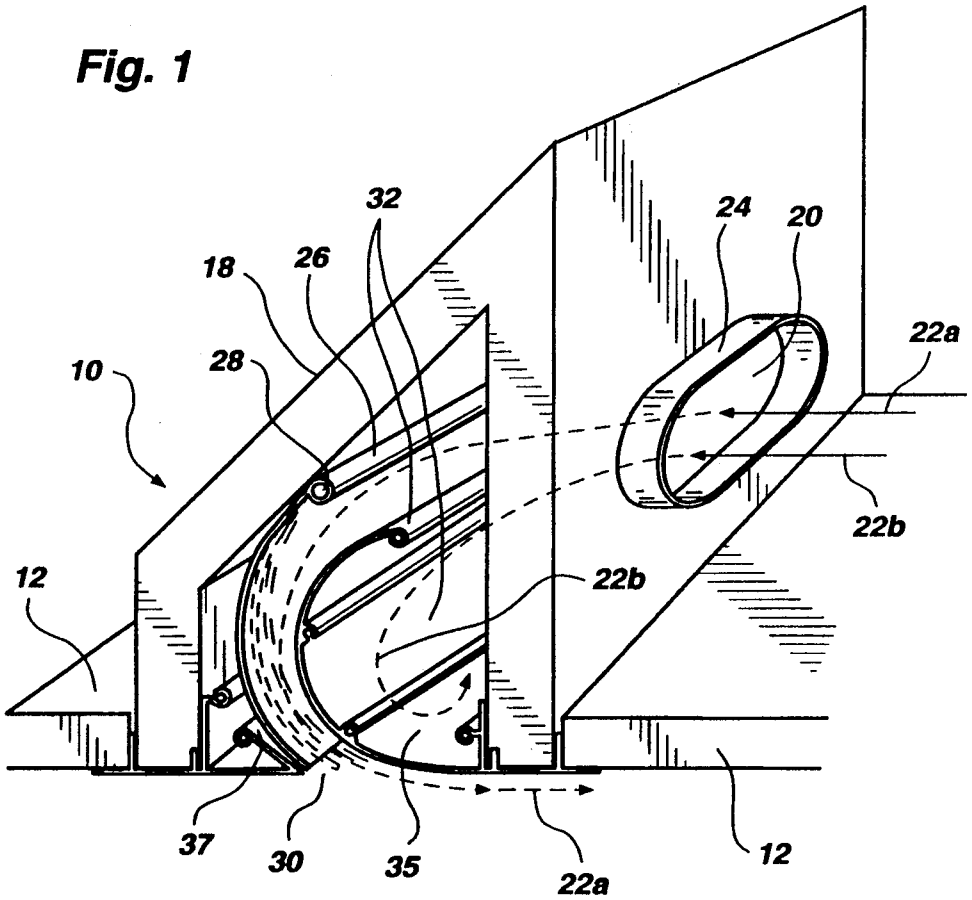
FIG. 1 shows a perspective view of a ceiling vent with a movable vane and an air catch mounted in a suspended ceiling, in accordance with the present invention.

Referring to the drawings, FIG. 1 shows a ceiling vent 10 mounted in a suspended ceiling 12. The ceiling vent 10 is not limited to mounting in suspended ceilings, however, and may be mounted in other ceilings, such as a gypsum board ceiling 14 as in FIG. 2. The ceiling vent 10 comprises a plenum 16 and a housing 18. The housing 18 may be insulated to minimize changes in temperature of the air as it flows through the ceiling vent 10. In the preferred embodiment, a wall of the housing 18 has an opening 20 through which a current of heated or cooled air **22*a* and 22*b* enters the plenum 16 from an air flow and plenum source. Connected to and extending outward from the housing 18 and surrounding the opening 20 is a sleeve 24 for connecting the ceiling vent 10** to a duct that conducts heated or cooled air from the source.

Attached to the inside of the housing 18 is a movable vane 26 which is an elongate curved sheet that is hingedly suspended at one end of the moveable vane from the housing 18 at a hinge point 28. This vane 26 is positioned in the housing to receive the force of the inflow of air into the plenum. The bottom of the housing 18 contains a slot 30 from which air exits the ceiling vent 10.

Continuous with an edge of the housing 18 adjacent to the slot 30 is a curved air catch 32. This air catch 32 is a partition or sheet curving upwardly and toward the opening 20 in the housing 18. The air catch 32 is also positioned in the path of incoming air. The juxtaposition of the vane 26 and air catch 32 forms a flow path or passage between the vane 26 and air catch 32 toward the exit opening 30. Part of the air flow **22*a* goes directly into this flow path, while part 22*b*** is diffused by circulation along the air catch and then into the flow path. This redistributes air flow to the edges for unifying the current velocities.

The hinge point 28 of the movable vane 26 is positioned so that gravity normally biases the vane 26 toward the air catch 32. Other methods of biasing the vane 26 toward the air catch 32 are by springs 50 or weights 51 which impose a comparable biasing load to that of gravity. If no air is flowing through the ceiling vent 10, then the vane 26 is in a closed position 34 in contact with the air catch 32. When air moves into the vent 10 from a source, the force of moving air moves the vane 26 away from the air catch 32. Depending on the velocity of the air, the vane 26 will move to a fully open position 36 or to any intermediate position 38 between fully open 36 and closed 34. The curved shape of the vane 26 redirects air as it flows through the vent 10 for laminar flow along the ceiling.

The distance between the bottom edge of the movable vane 26 and the curved surface of the air catch 32 defines an opening 40 of variable width through which air exits the vent 10 to the room. The width of the opening 40, as determined by the extent of deflection of the curved vane 26 in response to the force of inflowing air, regulates the velocity of outflowing air. Not only is the velocity of outflowing air regulated by the vent 10, but the outflowing air is directed by the interaction of the concave side of vane 26 and convex side of air catch 32 in a laminar flow along the ceiling of the room. As noted in the figures, the concavity of the vane 26 and the convexity of the air catch 32 are continuous along the passage sides of the respective vane and catch and up to the opening 40.

The air catch 32 diffuses and disperses the current of air that enters the ceiling vent 10, especially the air that enters at lower levels in the current, such as at **22*b*. The air catch 32 splits this air flow off and circulates it within the plenum and disperses it laterally, as depicted by dashed line 22*b*. The curved configuration of the air catch 32 generates a circular flow path within a forward portion 35 of the plenum, and then upward to the primary flow path 22*a*. The air that is thus circulated by the air catch 32 rejoins the upper level current of air 22*a*, is redirected by the movable vane 26, and exits the vent in a generally horizontal direction along the top of the room. The air catch 32, by dispersing air laterally within the vent 10** makes the velocity of outflowing air constant across the cross section of outflowing air instead of faster at the center of the outflow than at the edges. Further, air flow rates are increased by this homogenization of outflowing air.

Looking at the invention from another perspective, the vent 10 comprises a housing 18 that defines a chamber 16 through which air may pass from the plenum source into the room. The housing 18 contains an inlet opening 20 for supplying air to the chamber 16. Coupled to the inlet opening 20 are means 24 for attaching a conduit connecting the vent 10 to the plenum source. In the preferred embodiment, these means are a sleeve 24. Hingedly attached to the housing 18 within the chamber 16 is a vane 26 which may rotate about a rotational axis 28 and is positioned in the intended flow path of air **22*a* and 22*b* entering the chamber 16 through the inlet opening 20. The vane 26 exerts a deflecting resistance against the entering air 22*a* and 22*b* which causes rotation of the vane 26 to a variable degree in response to the velocity of the entering air 22*a* and 22*b*. The vent 10 also comprises an outlet opening 30 within the housing 18. This outlet opening 30 is positioned to receive air flow from the vane 26 and its opening size varies with the degree of rotation of the vane 26 in response to changing velocities of the entering air 22*a* and 22*b*. The outlet opening 30 is sufficiently small to provide a change in velocity to air flow as it exits the outlet opening 30. The invention also comprises means 32 associated with the vane 26 and outlet opening 30 for directing air flow and causing initial laminar flow of air exiting the outlet opening 30. In the preferred embodiment, these directing means 32 define an air catch 32**.

To illustrate how this ceiling vent 10 tends to maintain constant the air flow throw of air currents of varying velocities, comparison with a vent of fixed aperture is useful. High-velocity air moving through an aperture of fixed width will accelerate as it travels through the aperture. Thus, not only does the air enter the vent at high velocity, but it is accelerated as it exits. Low-velocity air moving through the same aperture may accelerate as it moves through the aperture as well, but the acceleration will be less than that of the high-velocity air. Thus, the difference in velocities of the high-velocity air and low-velocity air is increased after moving through the fixed aperture.

In contrast, the difference in velocity of high-velocity air and low-velocity air decreases after moving through a variable aperture that is responsive to the flow rate of air. Acceleration of the high-velocity air through the variable aperture will be less than it would have been through a fixed aperture because the aperture will widen in response to the force exerted by the high-velocity air against the movable vane 26. A limiting flange 37 blocks further movement rearward and sets the maximum size of the outlet. Also, acceleration of the low-velocity velocity air through the variable aperture will be more than it would have been through a fixed aperture because the aperture will narrow in response to the lower force exerted by the low-velocity velocity air against the movable vane 26. Thus, a ceiling vent 10 with a movable vane 26 to vary the aperture through which air exits to the room tends to maintain a more constant velocity of exiting air and, hence, a more constant air flow throw.

It is to be understood that the above-described arrangements are only illustrative of the application of the principles of the present invention. Materials for construction may include any formable structure of metal, plastic, ceramic, or the like. Numerous modifications and alternative arrangements may be devised by those skilled in the art without departing from the spirit and scope of the present invention and the appended claims are intended to cover such modifications and arrangements.

I claim:

1. A ceiling vent for dispersing air into a room in laminar flow with respect to a ceiling, comprising:

a housing having a planum, a first opening in the housing of the plenum for permitting inflow of air into the plenum, a second opening in the housing which also defines an opening of variable width in the ceiling for permitting outflow of air from the plenum into the room, and a vane having a concave curvature along its length which concave curvature extends continuously to the second opening, and being hingedly attached to the housing to form a movable side of the second opening for adjustment of opening size and being positioned to receive the force of the inflow of air into the plenum, wherein the position of the vane is reversibly responsive to the force of the inflow of air against the concave curvature and into the plenum to vary the size of the second opening with movement of the vane by the force while maintaining a curved flow path which discharges in laminar flow along the ceiling, and to stabilize the velocity of air that flows out from the plenum through the second opening into the room.

2. The ceiling vent according to claim 1 further comprising means for connecting an air duct to the vent.

3. A ceiling vent according to claim 1 further comprising force coupled to the vane which causes increased size of the second opening in response to increased force of an air flow against the vane.

4. The ceiling vent according to claim 1 wherein the second opening is configured as a slot, further comprising an air catch positioned in a flow path of the incoming air, wherein the air catch is a partition configured to (i) redirect air flow within the housing, and (ii) laterally disperse air within the housing to increase air flow rates at terminal portions of the slot.

5. The ceiling vent according to claim 4 wherein the air catch is curved and configured to generate a circular flow path within the plenum.

6. The ceiling vent according to claim 4 further comprising means for biasing the movable vane in a closing position toward the air catch and curved flow path between the vane and air catch toward the second opening.

7. The ceiling vent according to claim 6 wherein the means for biasing the movable vane toward the air catch is selected from the group consisting of gravity, a spring, and a weight.

8. The ceiling vent according to claim 6 wherein the means for biasing the movable vane toward the air catch is gravity and wherein the movable vane is biased to a closed position with a nominal opening as a second opening which creates increased flow rate through the nominal opening.

9. The ceiling vent according to claim 8 wherein movement of the movable vane forms a narrowing passage extending to the second opening for increasing air flow velocity and for directing the outflow of air from the vent in laminar flow along the ceiling of the room to stabilize air flow throw.

10. The ceiling vent according to claim 3 wherein the second opening is a slot in a bottom wall of the housing.

11. The ceiling vent according to claim 4 wherein the air catch is continuous with an edge of the bottom wall occurring at the slot and curves upwardly and toward the first opening.

12. A ceiling vent according to claim 1 further comprising an air catch, positioned in a flow path of incoming air in the ceiling vent wherein the air catch is a partition configured to redirect air flow within the vent and laterally disperse air within the vent to make uniform the velocities of air across the cross section of the air flow exiting from the vent.

13. The ceiling vent according to claim 1 wherein the movable vane forms one side of a narrowing passage having a concave curvature extending completely to the second opening for directing the outflow of air from the vent in laminar flow along the ceiling of the room to stabilize air flow throw.

14. The ceiling vent according to claim 1, wherein the vane is hingedly attached at one end within the housing, the vane being totally exposed to the outflow of air and resulting forces from contact with the outflow of air.

15. A ceiling vent for dispersing air into a room comprising a housing having a plenum, a first opening in the housing for permitting inflow of air into the plenum, means for connecting an air duct to the first opening, a second opening in the housing which also defines an opening of variable width in a ceiling for permitting outflow of air from the plenum into the room, and a curved vane having a continuous concave curvature along its length which extends to the second opening, and being hingedly attached to the housing and being positioned in the path of inflowing air, wherein the vane receives and is deflected by the force of inflowing air and the vane redirects outflowing air and regulates its velocity in response to the force, and a curved air catch comprising a sheet continuous with an edge of the housing at the second opening and curving upwardly into the plenum and toward the first opening, for redirecting air flow and laterally dispersing air within the plenum, said curved vane and curved air catch forming an air flow passage therebetween which has a continuous curvature narrowing toward the second opening.

16. The ceiling vent according to claim 15 further comprising means for biasing the curved vane toward the air catch, said air catch being configured and positioned so that when there is no inflow of air, the vane and air catch are in near contact to close a passage through which air flows, and when there is an inflow of air the force of the air moves the vane away from the air catch to variably open the passage.

17. The ceiling vent according to claim 16 wherein the biasing means are selected from the group consisting of gravity, a spring, and a weight.

18. The ceiling vent according to claim 17 wherein the biasing means is gravity and wherein the movable vane is biased to a closed position with a nominal opening as a second opening which creates increased flow rate through the nominal opening.

19. A vent for controlling entry of air into a room from a plenum source, said vent comprising a housing defining a chamber through which the air may pass from the plenum source into the room, an inlet opening in the housing for supplying air to the chamber, means coupled to the inlet opening of the housing for attachment of a conduit connecting the vent to the plenum source, a vane hingedly attached to the housing within the chamber to enable rotation of the vane about a rotational axis, said vane being positioned to define a flow path of air having a continuous concave curvature from a point of entering the chamber through the inlet opening and extending in length to an outlet opening to thereby apply a continuous deflecting resistance against the entering air which causes rotation of the vane to a variable degree in response to velocity of the entering air, the outlet opening within the housing positioned to receive air flow from the vane, said outlet having an opening size which varies with the degree of rotation of the vane in response to changing velocities of the entering air, said outlet opening being sufficiently small to provide change in velocity to air flow exiting the outlet opening, and directing means associated with the vane and outlet opening for causing initial laminar flow of air exiting the outlet opening.

20. A method of introducing a laminar flow of air into a room through a ceiling vent comprising (a) introducing a stream of air into a plenum located in a ceiling, (b) directing the stream of air to contact a movable vane within the plenum, (c) deflecting the path of the air along a continuous, concave curvature by moving the air along a continuous concave curvature of the movable vane extending from an inlet opening to an outlet opening which feeds directly at the ceiling, (d) increasing the size of the outlet opening by displacing the movable vane by the force of a higher velocity stream of air, wherein the higher velocity air contacting the movable vane causes larger displacement of the vane and a larger outlet opening resulting in a lower exit velocity from the vent, and wherein lower velocity air contacting the movable vane causes smaller displacement of the vane and a smaller outlet opening resulting in a higher exit velocity from the vent, and (e) conducting the air out of the vent into the room.

21. The method of claim 20 further comprising introducing a portion of the stream of air going into the plenum into contact with a curved air catch for circulating and laterally dispersing the stream of air before the air contacts the movable vane.

* * * * *